United States Patent [19]

Mueller

[11] Patent Number: 4,835,943

[45] Date of Patent: Jun. 6, 1989

[54] APPARATUS FOR APPLYING CONTAINER LIDS

[76] Inventor: Martin J. Mueller, 319 Crosswinds Dr., Palm Harbor, Fla. 34683

[21] Appl. No.: 175,913

[22] Filed: Mar. 31, 1988

[51] Int. Cl.[4] ..... B65B 7/28; B67B 3/22

[52] U.S. Cl. ..... 53/485; 53/202; 53/316

[58] Field of Search ..... 53/485, 316, 314, 313, 53/315, 202

[56] References Cited

U.S. PATENT DOCUMENTS

| | | | |
|---|---|---|---|
| 3,282,025 | 11/1966 | Amberg et al. . | |
| 3,440,794 | 4/1969 | Mueller | 53/314 |
| 3,487,622 | 1/1970 | Mueller . | |
| 3,867,807 | 2/1975 | Doucette | 53/314 X |
| 4,420,924 | 12/1983 | Hoyrup et al. | 53/307 |

FOREIGN PATENT DOCUMENTS

| | | | |
|---|---|---|---|
| 1383507 | 2/1975 | United Kingdom | 53/307 |

*Primary Examiner*—Horace M. Culver

*Attorney, Agent, or Firm*—Dressler, Goldsmith, Shore, Sutker & Milnamow, Ltd.

[57] ABSTRACT

An apparatus and method are disclosed for applying lids to respective cup-like containers. The apparatus includes a continuously operable destacker mechanism which is positioned generally beneath an assembly for holding stacks of the container lids. The destacker effects movement of the lowermost one of the lids from each of the stacks, with the lids thereafter moved to a feed magazine which includes a plurality of inclined guide chutes. The lids advance down the guide chutes, and are releasably retained in the path of filled containers moving on a conveyor generally therebeneath. Each container engages its respective lid, and withdraws it from the feed magazine, with the containers and lids subsequently passed beneath a series of application rollers so that the lids are urged downwardly into engagement with the containers.

9 Claims, 3 Drawing Sheets

APPARATUS FOR APPLYING CONTAINER LIDS

TECHNICAL FIELD

The present invention relates generally to packaging equipment, and more particularly to an apparatus and method for applying lids to containers by moving the lowermost lid from a stack, and positioning it for application to a container moving therebeneath.

BACKGROUND OF THE INVENTION

A wide variety of food products and other items are packaged in cup-like containers to which typically circular lids are applid. Ordinarily, packaging equipment for such products includes devices for destacking individual ones of the containers from stacks thereof, product-filling devices for placing the desired contents in the containers, and a lid applying apparatus for applying lids to the containers.

Like the containers, the container lids are typically provided in stacks, with destacking of individual lids required for subsequent application to respective containers. For example, U.S. Pat. No. 3,487,622, to Mueller, illustrates a capping apparatus which employs a rotatably movable vacuum cup for removing the lowermost lid from a stack of lids, and inverting and applying the lid to a container on an associated conveyor. Appropriate cam drives are provided for effecting the necessary reciprocating rotation of the vacuum cup for inversion of each container lid as it is moved from the stack to its respective container.

While the apparatus of the above patent has proven commercially successful, and suitable for reliable, high-speed packaging, packaging efficiency and attendant cost-reduction is promoted through the use of packaging machinery which is straightforward in design and operation, suited for high-speed packaging, and which is configured for convenient adjustability to permit its use with differently sized containers and different packaging equipment. In keeping with these goals, the present invention comprises an apparatus for applying container lids which is readily adaptable for high-speed use with a variety of existing packaging equipment, is desirably straightforward in operation, and is readily adjustable for use with differently sized containers.

SUMMARY OF THE INVENTION

The present invention contemplates a method and apparatus for applying lids to containers with desired efficiency and reliability. Notably, the apparatus of the present invention functions with continuous motion of its movable components while the container lids are handled in a generally upright configuration. In other words, reciprocating or intermittently operated machine elements are not employed, and inversion or like manipulation of each lid is avoided. Simplicity and high-speed operation are thus prompted.

The apparatus embodying the present invention is configured for use with an associated conveyor for cnoveying a series of the containers to which lids are to be applied. The conveyor may typically be part of an existing container filling apparatus, and ordinarily is operated either intermittently or continuously in association with a product filing station whereat filling is effected.

The present lid applying apparatus includes a stack holding assembly for holding at least one stack of the container lids. In a typical application, the container conveyor conveys a plurality of containers in side-by-side relation (such as two, three, or four), with the stack holding assembly preferably configured to hold a corresponding number of stacks of lids.

In accordance with the present invention, a continuous motion destacking mechanism is provided which is positioned generally beneath the stack holding assembly, and which is configured to effect destacking of the lowermost one of the lids from the respective one of the stacks. Notably, the destacked lid is in a generally upright orientation, with the present apparatus desirably obviating the need for any inversion or other like manipulation of each lid. The continuous motion nature of the mechanism greatly facilitates high-speed operation, since it avoids the speed limitations inherent in reciprocating or intermittently operated machine components. The use of vacuum-cups or the like is also desirably avoided.

The present apparatus further includes a feed magazine which is positioned generally above the container conveyor, and which receives the destacked lids in the generally upright orientation from the destacking mechanism. In the illustrated embodiment, the feed magazine comprises a plurality of inclined guide chutes which slidably receive the lids from the destacking mechanism. The feed magazine further includes an arrangement for releasably retaining the lowermost one of the lids in each guide chute in the path of the containers being conveyed therebeneath. Notably, the feed magazine is positioned and dimensioned relative to the destacking mechanism so that the destacking mechanism positively positions each lid in the desired orientation for transfer to the respective container. In this manner, each lid is engaged by its respective container, withdrawn from the feed magazine, and thereby applied to its respective container. Application rollers which extends transversely of the conveyor are preferably provided immediately downstream of the feed magazine, and urge the lids downwardly onto the containers as the lids and containers are conveyed therebeneath.

Other features and advantages of the present invention will become readily apparent from the following detailed description, the accompanying drawings, and the appended claims.

DETAILED DESCRIPTION

Figure 1:
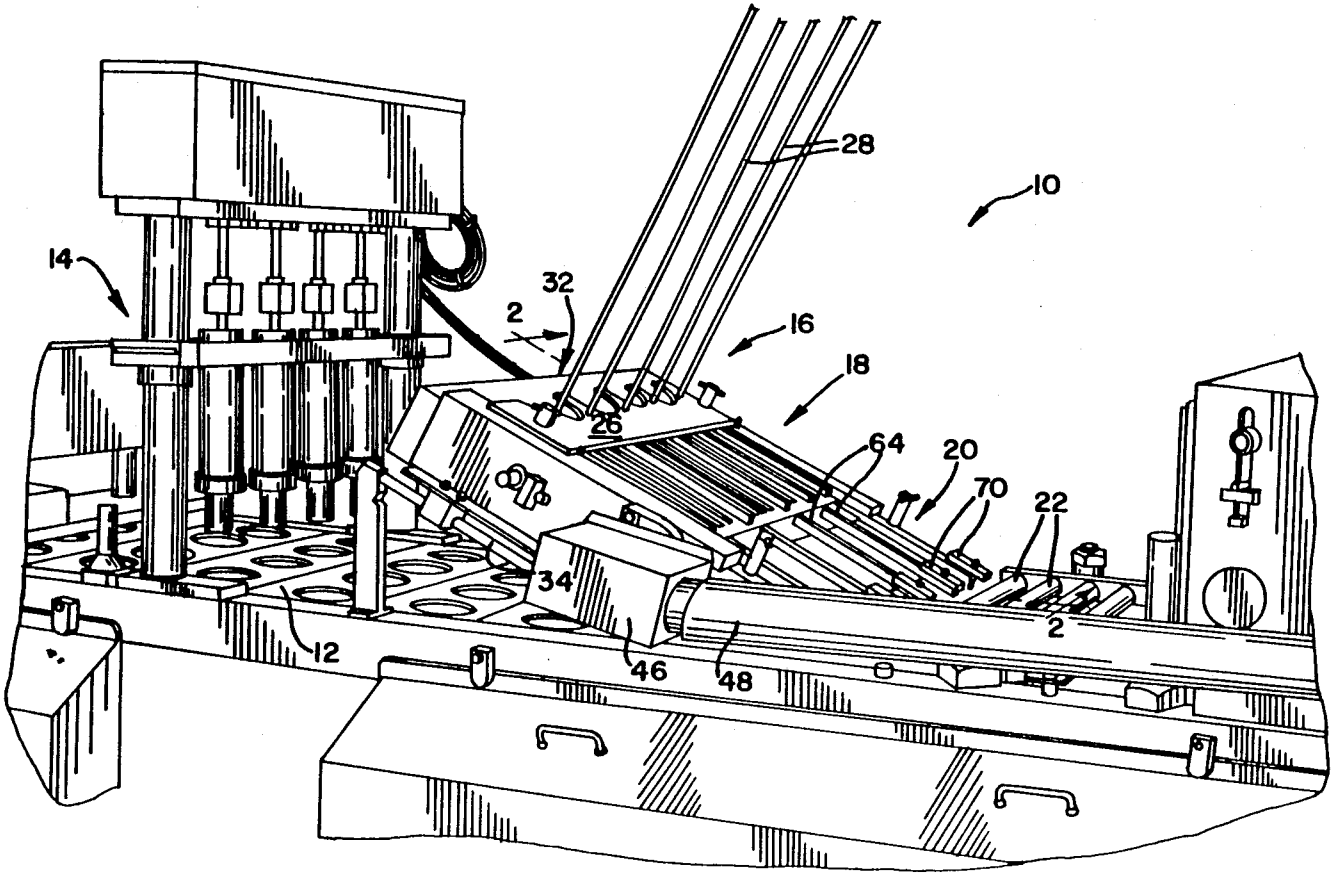
FIG. 1 is a perspective view of an apparatus for applying container lids embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a lid applying apparatus 10 embodying the principles of the present invention. As will be recognized by those familiar with the art, the present apparatus is typically incorporated into, or is operated in association with, a container filling apparatus. Desirably, a lid applying apparatus in accordance with the present invention can be readily adapted for use with existing filling machines, and efficiently retrofitted thereto.

As illustrated, the present apparatus 10 is positioned in operative association above a container conveyor 12, which in the illustrated embodiment, comprises a typical arrangement of container-holding conveyor flights, each of which holds four cup-like containers C (FIG. 2) in side-by-side relation. Filling of the containers is effected by product filling heads generally designated 14, with the conveyor 12 ordinarily operated on an intermittent basis so that each transverse row of containers is held beneath the filling heads 14 for filling, and thereafter conveyed (from left to right referring to the orientation of the drawings) to the lid applying station positioned downstream of the filling heads.

With further reference to FIG. 1, the lid applying apparatus embodying the present invention includes a stack holding assembly 16 for holding at least one, and preferably a plurality, of stacks of the container lids. The apparatus further includes a lid destacker, generally designated 18, and a feed magazine 20 which receives lids from the destacker. The present apparatus further preferably includes one or more application rollers 22 positioned downstream of feed magazine 20, with the application rollers 22 positioned transversely of the container conveyor 12 so that lids previously placed on their respective containers are urged downwardly onto the containers as the lids and containers pass beneath the rollers 22.

Figure 2:
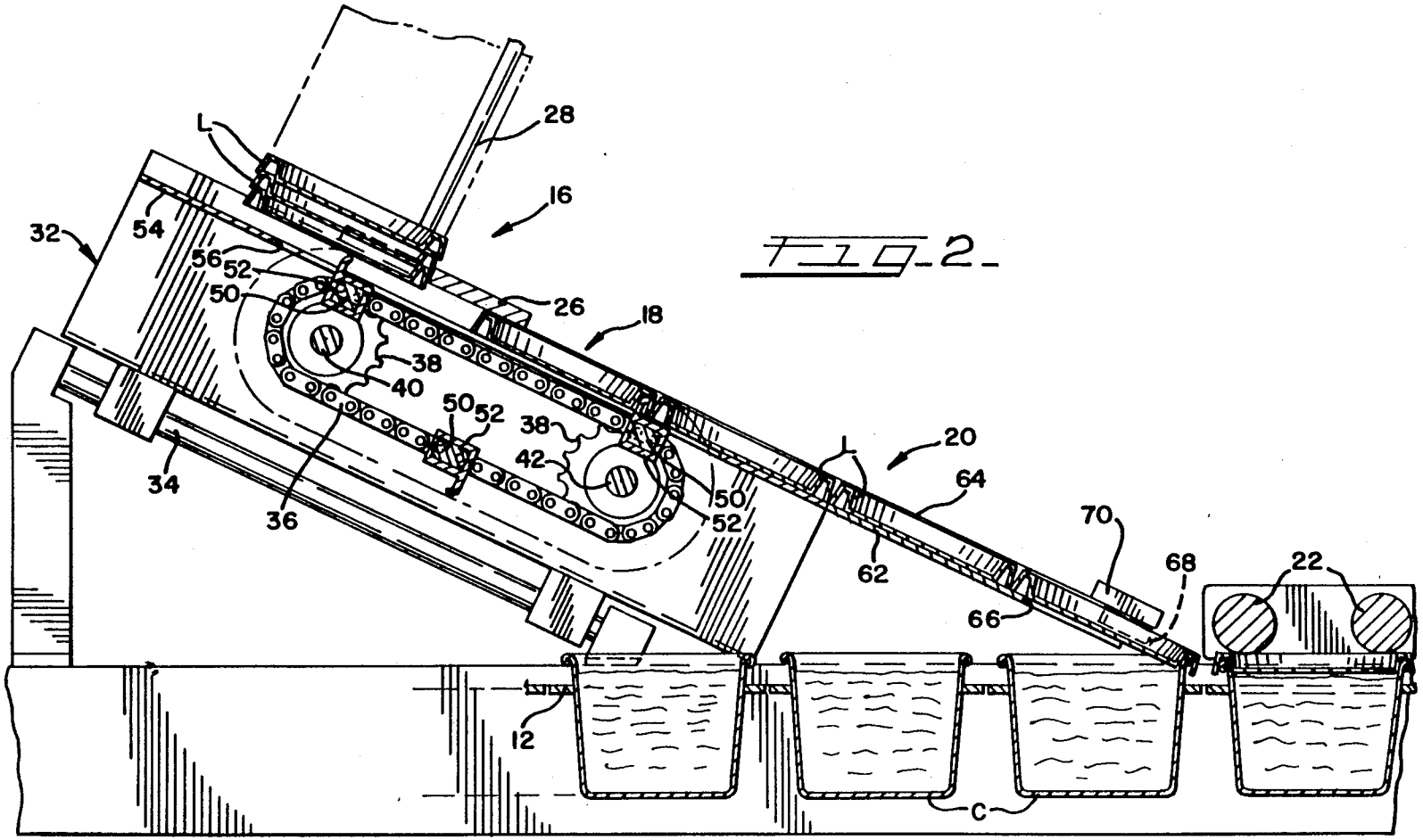
FIG. 2 is a cross-sectional view taken generally along lines 2—2 of FIG. 1 further illustrating the present lid applying apparatus.
Figure 3:
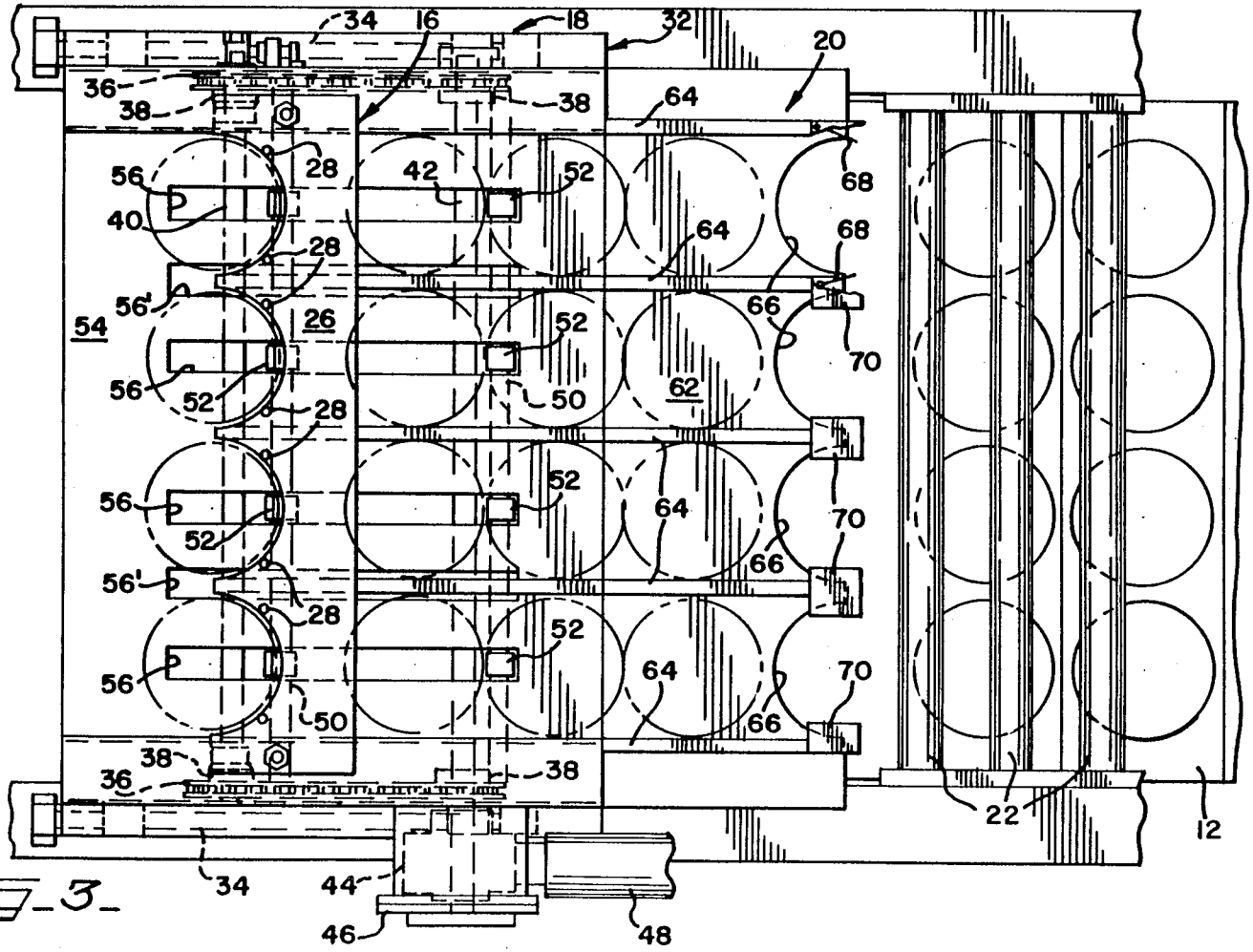
FIG. 3 is a top plan view of the present lid applying apparatus.

With particular reference to FIG. 2, the manner in which lids are destacked, and applied to respective containers, will now be described. As noted, stack holding assembly 16 holds one or more stacks of the container lids, and to this end, includes a stack holding plate 26 upwardly from which extend stack holding rods 28. As best shown in FIGS. 1 and 3, stack holding plate 26 defines a series of semi-circular cutouts corresponding in dimension to the container lids L. The holding rods 28 are positioned relative to the cutouts defined by holding plate 26 so that each stack of container lids is held at an angle or incline, thus promoting stability of the stack and convenient placement of additional lids on each stack.

With further reference to FIG. 2, the stack holding assembly 16 is positioned generally atop of destacker 18, which effects destacking of the lowermost lid from each stack. To this end, the destacker includes a continuously moving, conveyor-like mechanism which moves finger-like elements beneath the stacks of lids for moving or "stripping" the lowermost lid from each stack.

Destacker 18 includes a suitable housing 32, with the entire destacker preferably adjustably supported on inclined support rods 34 so that the destacker can be conveniently adjustably positioned relative to the container conveyor 12 which extends therebeneath. The conveyor-like destacker mechanism includes a pair of closed loop roller chains 36 positioned generally at transversely opposite sides of housing 32, with each chain 36 trained about a respective pair of sprockets 38. As shown in FIGURE 3, opposite ones of the sprockets 38 are mounted on a pair of transversely extending shafts 40, 42. In the illustrated embodiment, drive input to the destacker is provided via a right angle drive coupling 44 positioned within a suitable drive housing 46, which in turn is driven by a suitable shaft extending within drive shield 48. While an independent drive may be employed, the present apparatus is preferably operatively driven by the overall drive for the container conveyor 12 and other mechanisms of the filling apparatus, with the destacker thus operated in synchronization with the container conveyor 12.

In order to effect lid destacking, at least one support bar 50 (three being illustrated) extends between and is operatively connected to the roller chains 36. Thus, as the roller chains are continuously driven in unison, the support bar 50 is moved in the nature of a conveyor flight with destacking effected along the "upper run" of the conveyor-like structure.

Destacking of the lids from each stack is effected by a plurality of destacking fingers 52, a plurality of which are mounted on each support bar 50 corresponding to the plurality of stacks of container lids held by the stack holding assembly. Thus, as each support bar 50 is moved beneath the stacks of lids, the plurality of destacking fingers mounted thereon simultaneously destack the lowermost lid from each of the stacks. Each destacking finger 52 is preferably of a generally forwardly-open, hook-shaped configuration, as illustrated, to provide the desired engaging and disengaging action with the container lids. While the present invention is primarily intended for use with non-nestable container lids, it can be adapted for use with some types of nestable lids.

The manner in which destacking is effected is desirably straightforward and reliable. An upper housing plate 54 of the destacker defines a series of elongated finger slots or openings 56 respectively aligned with the centerlines of each stack of lids. As the roller chains 36 are driven, the fingers 52 on each support bar 50 are moved upwardly through respective ones of the slots 56, and into engagement with the lowermost lid of the respective stack.

The exact manner of engagement can be varied while keeping with the principles disclosed herein, depending in part upon the configuration and size of each lid. The illustrated embodiment is arranged such that as each finger 52 moves upwardly through slot 56, the finger engages the central panel portion of the lowermost lid L. During this action, the entire stack can be urged upwardly slightly. As the finger 52 moves forwardly relative to the stack, the finger moves into the downwarldy-open, annular recess defined by the lid, and the stack of lids moves downwardly to resume its original position relative to upper housing plate 54. The lowermost one of the lids is now separated and withdrawn from beneath the remaining lids of the stack, with the stack holding plate 26 acting to retain the remaining lids of the stack in position as the bottom lid is withdrawn. After the lowermost lid is completely clear of the stack, the remaining lids drop downwardly under the influence of gravity to again rest upon the upper housing plate 54, and the cycle is repeated.

For some type of lids, it can be desirable to engage the trailing edge of the lowermost lid with the destacking finger 52, and thereby push each lid so that it is moved from beneath the remaining lids. To this end, the stack holding assembly 16 is preferably adjustably mounted on destacker housing 32 so that the assembly 16 can be moved relative to the upper ends of finger slots 56.

One particularly desirable feature of the present invention is its adaptability for differently sized container lids without the need to replace or significantly alter the destacker drive mechanism. To this end, the upper housing plate 54 of the destacker housing may define additional ones of the finger slots, with two such slots designated 56' in FIG. 3. As will be appreciated, slots 56' are positioned such that they would be oriented along the centerlines of two stacks of relatively larger lids, and would originally be employed in association with a container conveyor wherein each flight conveys two side-by-side containers.

Application of such larger lids is readily effected by replacing the stack holding assembly 16, providing an appropriately dimensioned feed magazine 20, and adjusting the destacker 18 along the support rods 34 as may be required. Additionally, destacker fingers 52 are preferably configured for adjustable positioning along the respective support bars 50, thus promoting the adaptability of the present apparatus for different containers and equipment configurations.

Referring again to FIG. 2, the lid which has been withdrawn from each stack is moved downwardly generally at an incline until the destacker finger 52 disengages the lid and moves downwardly beneath upper housing 54 as roller chains 36 pass about the sprockets 38 on the shaft 42. Transfer of the lids from the destacker 18 to the feed magazine 20 is now effected, with the feed magazine configured for application of the lids to the containers on conveyor 12.

The feed magazine 20 includes a generally planar chute plate 62 with a plurality of chute guides 64 preferably provided thereon to define a plurality of inclined guide chutes for slidably receiving the destacked lids. Chute guides 64 may extend onto the upper surface of destacker 18, and may comprise single, elongated guides between each chute, or may be of a segmented construction, as desired.

Chute plate 62 defines a plurality of semi-circular cutouts 66 at the lower edge thereof, with the cutouts 66 corresponding to the guide chutes provided by the feed magazine. The feed magazine is positioned above the container conveyor 12 so that the lids are positioned to extend generally into the path of the containers for application thereto.

To this end, each guide chute is provided with means for releasably retaining the lids therein in the desired chute, angularly inclined relationship relative to the direction of movement of the containers being conveyed. This is achieved by the provision of suitably resiliently deformable retaining fingers 68 (see FIG. 3), a pair of which is operatively positioned at the respective opposite sides of each semi-circular cutout 66.

By this arrangement, the lids slide down each guide chute until they engage the retaining fingers 68, and are thus held in a position such that the forward edge of the lid projects down into the path of the moving containers. The lowermost lid in each guide chute is thus in position for engagement by its respective container, and is withdrawn from the chute, and released from the fingers 68, as it is engaged by the container and is withdrawn from the chute. In this regard, upper retaining blocks 70 are provided above the pairs of retaining fingers 68, and thus prevent the lids from moving upwardly as they are withdrawn from the guide chutes. Cutouts 66 permit the lids to move downwardly as each lid is engaged by its respective container and withdrawn from the retaining fingers 68.

Reliable, consistent operation of the present apparatus is promoted by the manner in which destacking fingers 52 are arranged to cooperate with the retaining fingers 60 of the feed magazine. Specifically, the feed magazine is positioned and dimensioned relative to the destacker 18 so that the exact distance between the point where the destacking fingers 52 disengage the lids, and the point where the lids are retained by retaining fingers 68, is predetermined for the particular lids to be handled. By such positioning, the destacking fingers act during disengagement and release of a lid to urge or push the downstream-most one of the lids in the respective guide chute of the feed magazine into the retaining fingers 68 so the lid is positioned for application to its respective container. In other words, the destacking fingers 52 act through the lids in the feed magazine 20 to positively urge and position the lowermost lid in the respective chute of the magazine into the retaining fingers 68, with this lid thus positively positioned as necessary for the desired engagement and withdrawal by the respective container on conveyor 12. Thus, although the lids tend to slide down the feed magazine by gravity, the lids are, in fact, positively and precisely positioned in the retaining fingers 68 by the destacking fingers 52. Interchanging of appropriately dimensioned ones of the feed magazine 20 permit use of the destacker 18 with a wide variety of different containers.

After each lid is transferred to its respective container, the containers and lids pass beneath a series of application rollers 22 which extend transversely of the conveyor 12. Rollers 22, which may be spring-loaded downwardly, or positioned progressively closer to the conveyor, engage each container lid, and urge it downwardly onto its respective container. The filled and covered containers are thereafter further processed and packaged as may be required.

From the foregoing, it will be observed that numerous modifications and variations can be effected without departing from the true spirit and scope of the novel concept of the present invention. It is to be understood that no limitation with respect to the specific embodiment disclosed herein is intended or should be inferred. The disclosure is intended to cover by the appended claims all such modifications as fall within the scope of the claims.

What is claimed is:

1. An apparatus for applying lids to a series of containers being conveyed by associated conveyor means, comprising:

stack holding means for holding at least one stack of said lids;

destacking means for destacking the lowermost one of said lids from the respective one of said stacks with said one lid maintained in a generally upright orientation, comprising at least one continuously moving destacking finger engageable with the lowermost one of said lids in each stack for moving said one lid from beneath the remaining lids of the respective stack, said destacking finger disengaging said one lid after said one lid is moved from beneath the remaining lids of the respective stack; and feed magazine means positioned generally above said conveyor means for receiving said destacked lids in the generally upright orientation from said destacking means, and for applying each said lid to a respective one of said containers being conveyed by said conveyor means, said feed magazine means being positioned relative to said destacking means such that as said destacking finger disengages said one lid, the destacking finger simultaneously urges the downstream-most lid in said feed magazine means into position for application to the respective one of said containers.

2. An apparatus for applying lids in accordance with claim 1, including means for urging said destacked lids onto said containers.

3. An apparatus for applying lids in accordance with claim 2, wherein said means for urging comprises at least one roller means extending transversely of said conveyor means and positioned downstream of said feed magazine means, said roller means being positioned for engagement with said lids for urging said lids downwardly onto said containers as the lids and the containers pass beneath said roller means.

4. An apparatus for applying lids in accordance with claim 1, wherein:

said stack holding means is configured to hold a plurality of said stacks of said lids, said destacking means comprising a pair of transversely spaced, closed loop roller chain means between which extends at least one finger support means, each said finger support means including at least as many of said destacking finger as there are stacks of said lids so that the plurality of destacking fingers on each said finger support means simultaneously destack the lowermost ones of said lids of said plurality of stacks.

5. An apparatus for applying lids in accordance with claim 4, including means for adjustably mounting said destacking finger on said finger support means to facilitate repositioning of said finger means for differently sized container lids.

6. An apparatus for applying lids in accordance with claim 1, wherein said feed magazine means comprises an inclined guide chute corresponding to each of said stacks of lids for slidably receiving said lids from destacking means, said feed magazine including retaining means for releasably retaining the lowermost one of said lids in said inclined guide chute means in the path of said containers being conveyed for application to a respective one of said containers.

7. An apparatus for applying lids to a series of containers being conveyed by associated conveyor means, comprising:

stack holding means for holding at least one stack of said lids;

destacking means for destacking the lowermost one of said lids from the respective one of said stacks with said one lid maintained in a generally upright orientation, said destacking means comprising at least one continuously movable destacking finger engageable with the lowermost one of said lids in each stack for moving said one lid from beneath the remaining lids of the respective stack, said destacking finger disengaging said one lid after said one lid is moved from beneath the remaining lids of the respective stack;

feed magazine means positioned generally above said conveyor means for receiving said destacked lids in said generally upright orientation from said destacking means, and for applying each said lid to a respective one of said containers being conveyed by said associated conveyor means, said feed magazine means comprising inclined guide chute means for slidably receiving said lids from said destacking means, and means for releasably retaining the lowermost one of said lids in said inclined guide chute means in the path of said containers being conveyed for application to the respective one of said containers, said feed magazine means being positioned relative to said destacking means such that as said destacking finger disengages said one lid, the destacking finger simultaneously urges the lowermost lid in said feed magazine means into position to be releasably retained by said retaining means for application to the respective one of said containers; and application means for urging said lids onto said containers as said lids and said containers are conveyed beneath said application means.

8. A method of applying lids to a series of containers being conveyed by associated conveyor means, comprising the steps of:

providing at least one stack of said lids;

destacking the lowermost one of said lids from the respective one of said stacks with continuously moving destacking finger means, with said one lid maintained in a generally upright orientation;

providing feed magazine means for receiving said lids from said destacking finger means, and moving said lids from said destacking means to a position generally above said containers being conveyed;

releasably retaining each said lid to extend generally into the path of said containers being conveyed for application of each said lids to a respective one of said containers; and disengaging said finger means from said one lid after said one lid is moved from beneath the remaining lids of the respective stack, whereupon said finger means urges the downstream-most lid in said feed magazine means into position for said releasably retaining step for application to the respective one of said containers.

9. A method of applying lids in accordance with claim 8, including conveying said containers and the lids thereon beneath application means for urging said lids downwardly onto said containers.

* * * * *